US005785188A

United States Patent [19]

Ogden

[11] Patent Number: 5,785,188

[45] Date of Patent: Jul. 28, 1998

[54] VALANCE FOR STORING AND DISPLAYING ITEMS

[76] Inventor: Patricia P. Ogden, 5995 Riverwood Dr., NW., Atlanta, Ga. 30328

[21] Appl. No.: 667,029

[22] Filed: Jun. 20, 1996

[51] Int. Cl.[6] ..... A47F 5/00

[52] U.S. Cl. ..... 211/88.01; 160/38; 211/87.01

[58] Field of Search ..... 211/88.01, 87.01; D8/376, 377; 160/38, 39, 123, 330, 368.1

[56] References Cited

U.S. PATENT DOCUMENTS

| | | | |
|---|---|---|---|
| 2,569,290 | 9/1951 | Collester | 160/330 X |
| 4,654,991 | 4/1987 | Jones | 40/617 |
| 4,664,266 | 5/1987 | Fausett et al. | 211/87.01 |
| 4,736,853 | 4/1988 | O'Mara | 211/69.1 X |
| 5,230,375 | 7/1993 | Linder | 160/39 |
| 5,337,907 | 8/1994 | McKenzie et al. | 211/88.01 |
| 5,615,722 | 4/1997 | Garrett et al. | 160/330 X |

*Primary Examiner*—Robert W. Gibson, Jr.
*Attorney, Agent, or Firm*—Levisohn, Lerner, Berger & Langsam

[57] ABSTRACT

A valance for storing and displaying items such as stuffed animals or dolls. The valance has pouches formed on its front into which the items are placed. The pouches are provided with a spacer and/or loose fill for increasing the interior volume of the pouch, thereby giving the pouch a three-dimensional appearance. The spacer or fill may also serve to elevate the items so that they are visible over the front flap of the pouch. The valance may be two pieces of fabric sewn together to form pouches bound by the seams. Alternatively, the valance may be a piece of fabric having loops, through which a scarf-like second piece of fabric is threaded. The droop of the scarf between the loops forms the pouches into which the items are placed.

19 Claims, 9 Drawing Sheets

VALANCE FOR STORING AND DISPLAYING ITEMS

BACKGROUND OF THE INVENTION

1. Field of the Invention

The invention pertains to valances, and more particularly to a valance for storing and displaying items such as dolls or stuffed animals.

2. Description of Related Art

As more and more people move to urban areas, many families are finding living space, particularly in apartments, to be at a premium. Families with children must constantly balance purchasing more toys for the children and limited storage space. Even where storage space is not problematic, parents would like to prevent their homes from being littered with toys all the time.

A type of children's toy that is rather bulky is the stuffed animal. Purchasing a number of stuffed animals can cause a storage problem. Leaving stuffed animals on the floor or on a bed is ineffective, is not aesthetically pleasing, and can be a nuisance for parents. Putting stuffed animals away in a closet deprives the child of the ability to view his or her collection, and presupposes closet space is available. A toy chest is another unsuitable solution, in that the chest occupies a significant amount of floor space and again prevents the toys from being seen.

Another attempt to solve this problem consists of attaching a chain to the ceiling of a room by a hook; the chain is provided with clips which are designed to secure stuffed animals to the chain. While the stuffed animals are visible, the chain does not hang attractively, and the clips are limited in what they can be designed to hold.

In still another attempt, a hammock made of a netting material is attached to the corner and/or ceiling of a room, and stuffed animals are secured within. Again, like the chain, while the hammock allows the toys to be seen, the overall look is not aesthetically pleasing. In addition, by trapping the toys in netting close to the ceiling, it becomes difficult to remove a toy should the child wish to play with one.

Another toy storage device is illustrated in U.S. Pat. No. 2,569,290 to Collester, in which a curtain having pockets and a front flap is described. The front flap shields the pockets from view so that toys may be placed in the pockets and thus concealed. While the curtain of Collester has the advantage of storing toys in a manner in which the toys may be easily removed for play, Collester fails to provide a way of storing and simultaneously displaying toys.

Thus, there exists a problem in the art, in that children's toys have not been stored and also displayed in an aesthetically pleasing manner which allows easy access to the toys.

SUMMARY OF THE INVENTION

The above and other problems are solved by the invention, which is a valance for storing and displaying items such as dolls and/or stuffed animals. The valance is attachable to a support that is to be suspended from a wall. The valance includes a body having a front face and an upper portion, and a flexible pouch coupled to the front face of the body. The valance also includes a support attachment coupled to the upper portion of the body and attachable to the support to suspend the body from the support.

The pouch is dimensioned to receive the items. The pouch can be held in an expanded state to increase the volume of the pouch, as well as to puff out the pouch from the body of the valance, by means of a somewhat rigid spacer and/or by loose fill. The pouch may also be provided with support means, disposed in the pouch, for supporting and elevating any items placed inside the pouch so that a desired portion of the item is displayed above the upper edge of the pouch.

The invention also includes a method of constructing the valance. First, two fabric panels, one for the body and one for the pouch, are selected, each of the panels having a predetermined size and having a front face and a back face. Next, the body panel and the pouch panel are coupled together, with the back face of the pouch panel facing the front face of the body panel thereby forming a pouch. The pouch panel may be coupled to the body by stitching, or may be in the form of a scarf-like piece that is threaded through loops provided on the body.

DETAILED DESCRIPTION

The valance of the invention includes a body and a flexible pouch coupled to the front face of the body. The body includes a support attachment coupled to an upper portion of the body. The support attachment is attachable to a wall support, such as a curtain rod, for suspending the body from a wall. Any support attachment suitable for supporting a curtain is intended, and may include rings, loops of fabric, a rod pocket, or the like.

The pouch is dimensioned to receive items such as dolls, stuffed animals, and plush toys. The pouch can preferably be held in an expanded state to increase the volume of the pouch, as well as to puff out the pouch from the body of the valance so as to make the pouch resemble other three-dimensional objects such as train cars, boat hulls, and the like. The pouch can be held in the expanded state by means of a somewhat rigid spacer, by loose fill, or by both. The pouch may also be provided with support means, disposed in the pouch, for supporting and elevating any items placed inside the pouch so that a desired portion of the item is displayed above the upper edge of the pouch. The items may be supported by being placed on top of loose fill, or by a somewhat rigid spacer having a substantially horizontal surface.

The valance is preferably formed of a body panel and a pouch panel. The body panel and pouch panel may be joined along respective horizontal edges to form a horizontal seam and along at least two vertical edges to form outer vertical seams. The horizontal seam and the outer vertical seams define the pouch. Intermediate vertical seams, disposed between the outer vertical seams, may preferably be provided, so that a plurality of pouches are formed in the valance. In an alternative embodiment, the body panel has loops attached to its front and the pouch panel is threaded through the loops and allowed to droop between the loops. This "scarf-type" valance forms pouches in the drooping portions of the second piece, and stuffed animals or dolls may be placed therein.

Preferably, both the spacer and the fill are used together. If the spacer is placed in the pouch with a horizontal surface closer to the bottom of the pouch, the fill may be placed in the interior volume of the spacer, so that the stuffed animals or dolls rest on top of the fill inside the spacer. If the spacer is placed in the pouch with a horizontal surface closer to the top of the pouch, the fill can be placed on top of the horizontal surface of the spacer, and the stuffed animals are placed on top of the fill.

Figure 1:
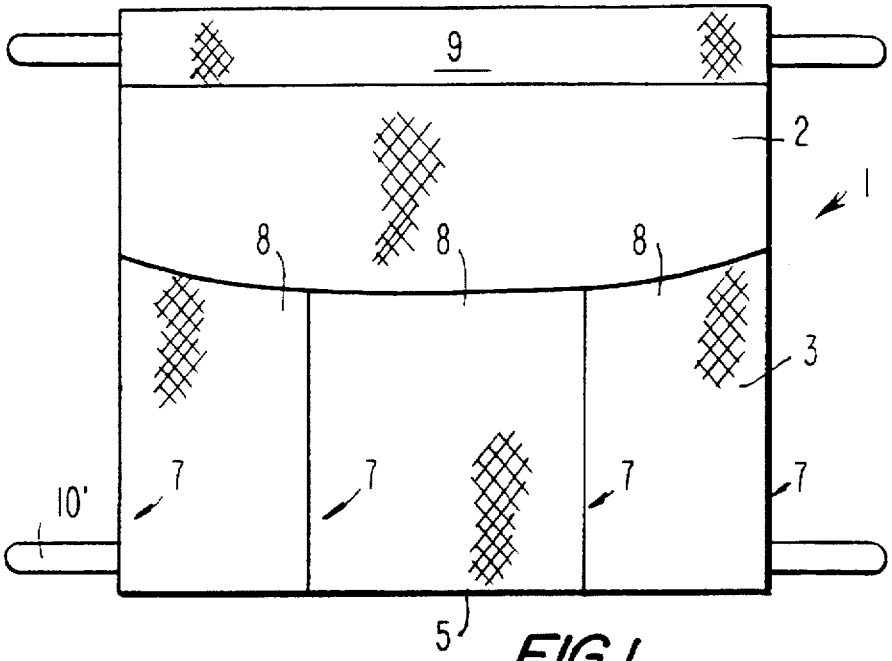
FIG. 1 is a schematic of a first embodiment of a valance for storing and displaying items.

As illustrated in FIG. 1, valance 1 includes a pouch flap 3 sewn onto a main flap 2. Vertical seams 7 are sewn at the outermost edges of flaps 2 and 3, thereby forming at least one pouch 8. If multiple vertical seams 7 are sewn, as shown in FIG. 1, multiple pouches 8 are formed. Articles to be displayed, such as stuffed animals 12 (see FIGS. 4–7), may then be placed in pouches 8. The stuffed animals are thus stored in a visible fashion, and are easily removed from the valance. The top portion of main flap 2 may be folded over itself and sewn to form rod compartment 9, through which a curtain rod 10 or a similar hanging device can be inserted. In this way, valance 1 may be suspended from a wall. Another rod compartment (not shown) may be provided in the lower end of valance 1 through which a second rod 10' may be disposed, to weigh down valance 1.

Figure 2A:
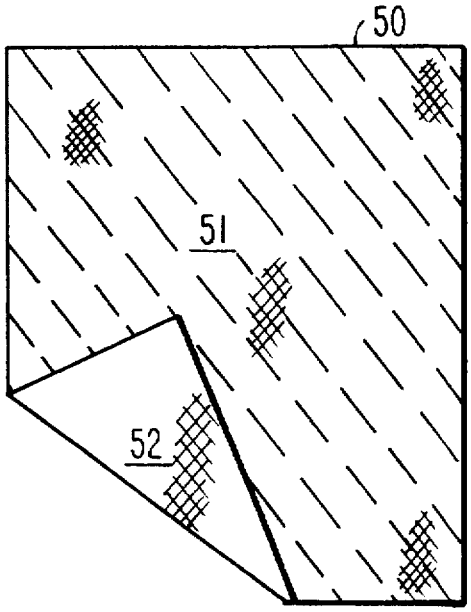
FIG. 2*a* is a representation of the fabric panels used to form the valance of FIG. 1.
Figure 2B:
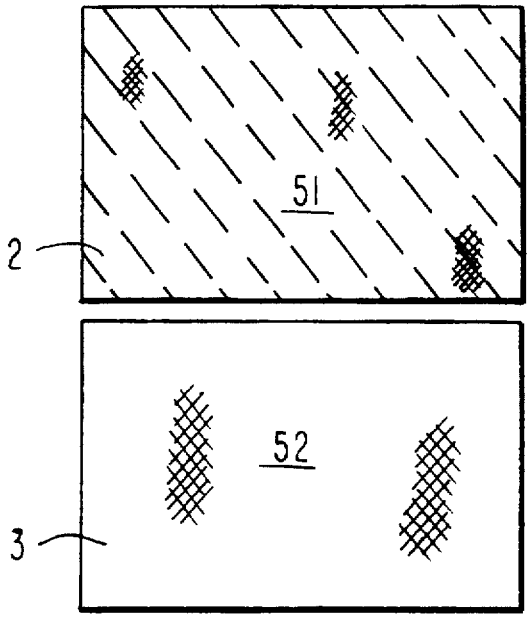
FIGS. 2*b*–2*c* are representations of first and second construction steps in forming the valance of FIG. 1.
Figure 2C:
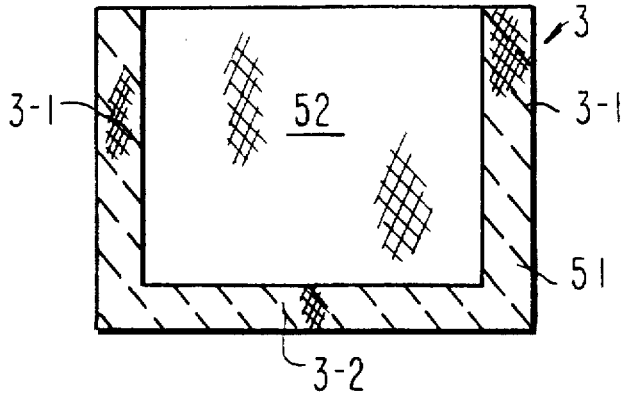

One suitable construction for valance 1 is shown in FIGS. 2–3. As shown in FIG. 2*a*, the basic construction material is fabric 50, which may have a patterned side 51 and a non-patterned side 52. Fabric 50 may be cut into two pieces which will form flaps 2 and 3. Alternatively, two separate pieces of fabric may be used, preferably also having a patterned side 51 and a non-patterned side 52. Pouch flap 3 is oriented to be opposite main flap 2, so that the patterned side of main flap 2 faces the same direction as non-patterned side 52 (see FIG. 2*b*). As shown in FIG. 2*c*, the two vertical edges of pouch flap 3 are folded over and seamed at seams 3-1, while the lower horizontal edge of the pouch flap 3 is folded over and seamed at seam 3-2. Seams 3-1 and 3-2 are folded so that the patterned side 51 is folded over the non-patterned side 52.

Figure 3A:
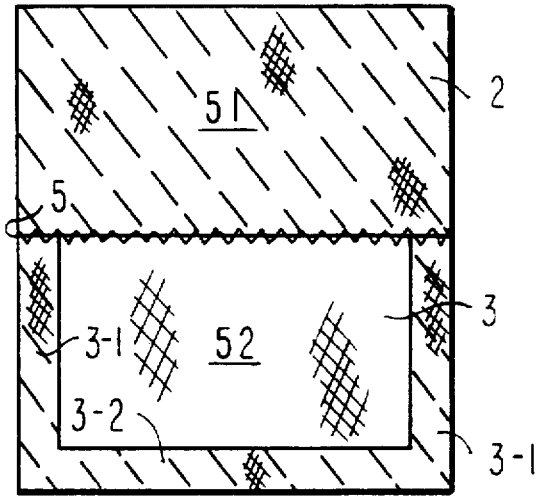
FIGS. 3*a*–3*b* are representations of construction steps subsequent to that shown in FIG. 2*c*.
Figure 3B:
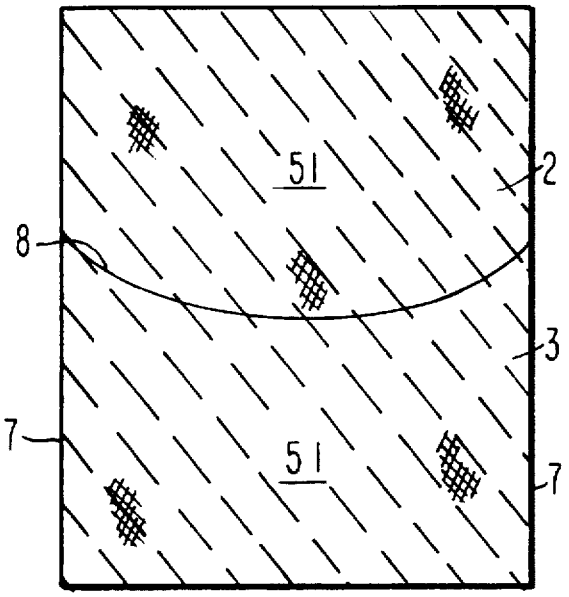

Next, pouch flap 3 is attached to main flap 2 at seam 5, as illustrated in FIG. 3*a*. Finally, pouch flap 3 is folded up towards main flap 2, and vertical seams 7 are added to form pouch 8. While not clear in FIGS. 2*b* and 3*a*, main flap 2 is generally larger than pouch flap 3 (see FIG. 3*b*), so that when pouch flap 3 is folded up and sewn at vertical seams 7, the top edge of pouch 8 comes up only a portion of the way on main flap 2. In this way, the patterned sides 51 of flaps 2 and 3 both face the same direction and are both visible. As mentioned above, multiple vertical seams 7 may be provided, thereby forming several pouches 8.

Figure 8:
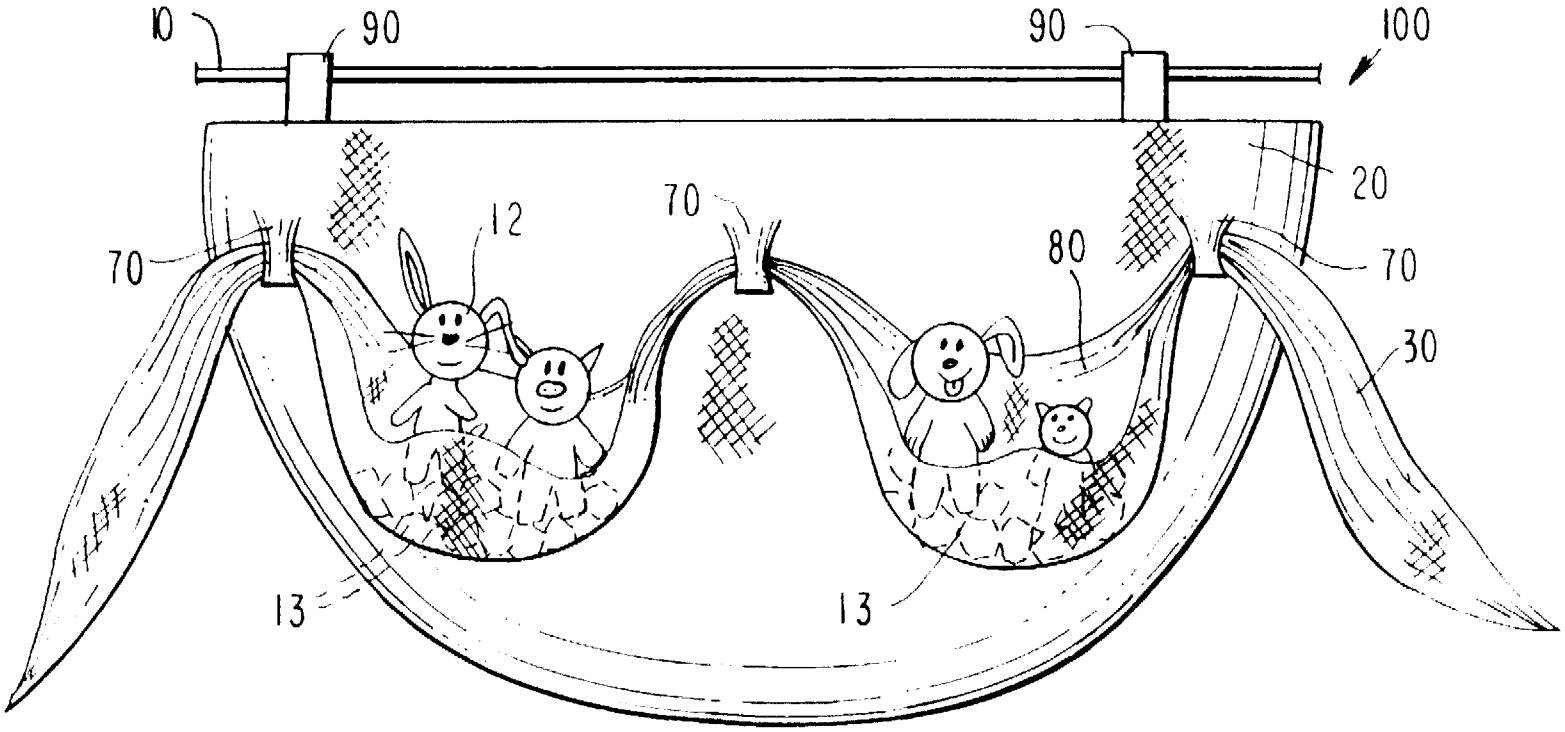
FIG. 8 is a front view of a second embodiment of a valance for storing and displaying items.

A second embodiment of the invention will now be described with reference to FIG. 8. Instead of individual pouches formed by vertical seams, the valance 100 forms pockets from a drooping piece of fabric gathered up and secured at discrete points. Valance 100 includes main sheet 20 and scarf 30. Main sheet 20 is provided with support loops 70 or similar securing structure. Scarf 30 is threaded through loops 70, and allowed to hang slack between the loops. The drooping of scarf 30 creates pouches 80, in which items such as stuffed animals 12 may be placed. Valance 100 may be secured to a wall as in the first embodiment, using a rod compartment and a curtain rod, or it may be provided simply with rod loops 90, through which curtain rod 10 may be threaded.

While the valance designs described above accomplish the identified objectives, including simultaneously displaying and storing items such as dolls and stuffed animals, the aesthetics and functions of the valance can be enhanced by maintaining the pouch in an expanded state. The valance may preferably be provided with a pouch expander that "puffs" the pouches outward, thereby giving a more three-dimensional appearance to the valance, providing increased rigidity and support to the pouches, and preventing pouch flap 3 from sagging or drooping in an unflattering fashion. By providing a three-dimensional appearance to the pouch and properly selecting the geometry of the pouch expander, a pouch can be made to resemble other things appropriate for a child's room, such as books, train cars, etc. The pouch expander can serve to elevate a relatively small stuffed animal 12 so that it is visible over the top of pouch flap 3. The pouch expander may also be used in pouches 80 of FIG. 8.

Figure 4A:
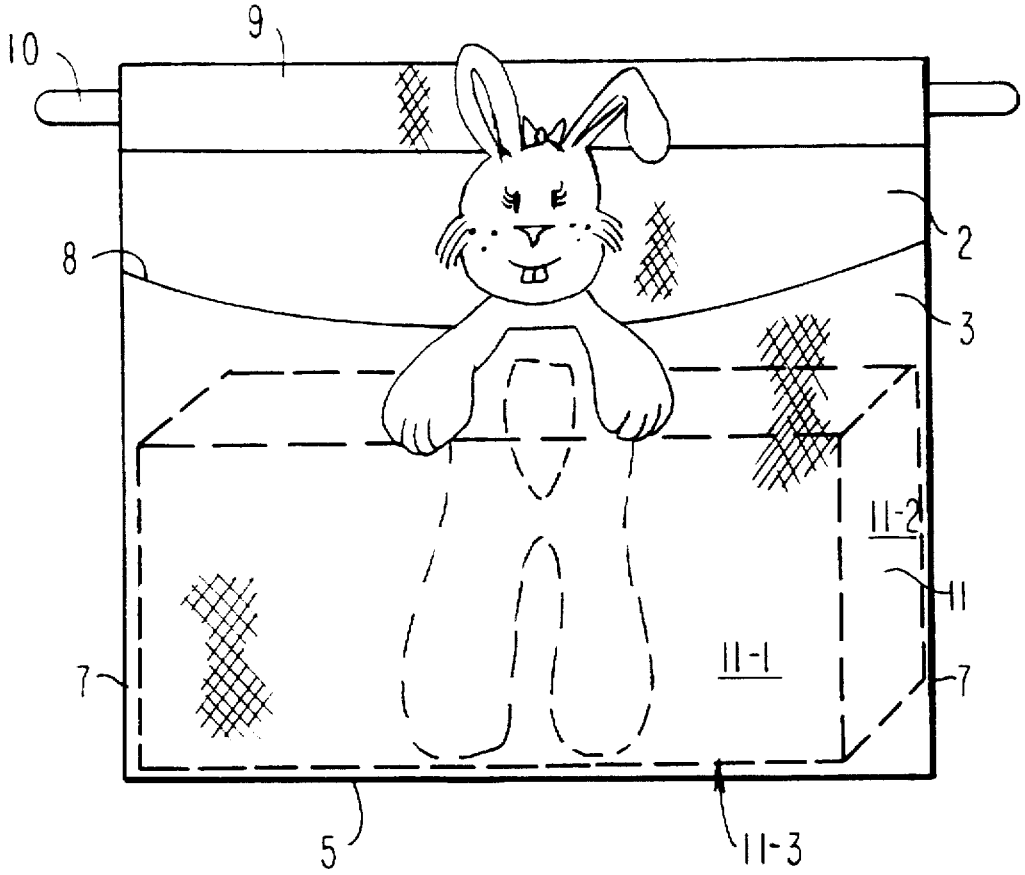
FIGS. 4*a*–4*b* are front views of a one-pouch portion of the valance of FIG. 1, with a first expanding member shown in outline in the pouch in two different orientations.
Figure 4B:
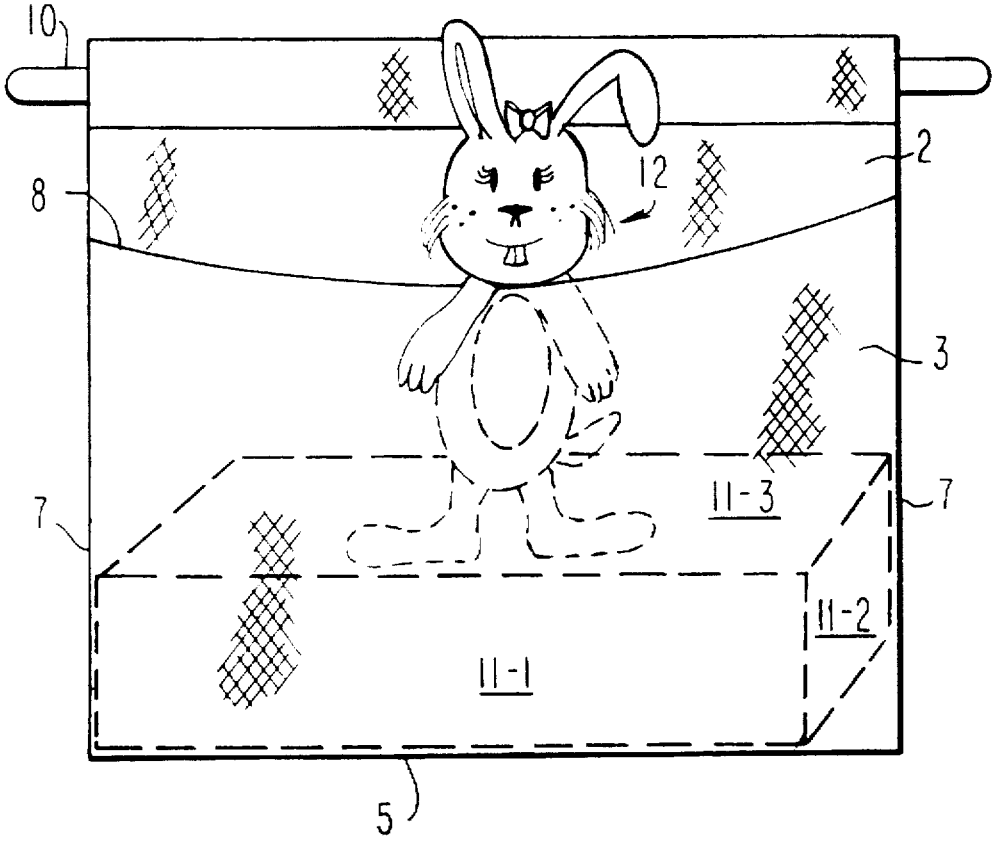

One of the preferred pouch expanders that may be added to the valance is spacer or box member 11, shown in FIGS. 4*a–b*. Box member 11 preferably has front and rear walls 11-1, side walls 11-2, and a bottom wall 11-3, thereby forming the shape of an open box. Box member 11 is disposed inside pouch 8 between pouch flap 3 and main flap 2 where the two flaps overlap, and thus expands the interior volume of pouch 8. The dimensions of box member 11 are selected so as to fit snugly within pouch 8. In one configuration, as shown in FIG. 4*a*, box member 11 is oriented inside pouch 8 with bottom wall 11-3 disposed at or near the bottom of the pouch. When stuffed animal 12 or a similar item is placed in pouch 8, it is actually placed within the interior of box member 11. In another configuration, as shown in FIG. 4*b*, box member 11 is inverted, so that bottom wall 11-3 forms a platform upon which stuffed animal 12 may rest when placed inside pouch 8. This configuration is preferred for storing smaller stuffed animals and dolls, which might not be visible over the top of pouch flap 3.

Box member 11 is preferably made from an inexpensive and somewhat rigid material. Materials that would be advantageous include cardboard, heavy gauge paper, wood, plastic, and the like.

Figure 5:
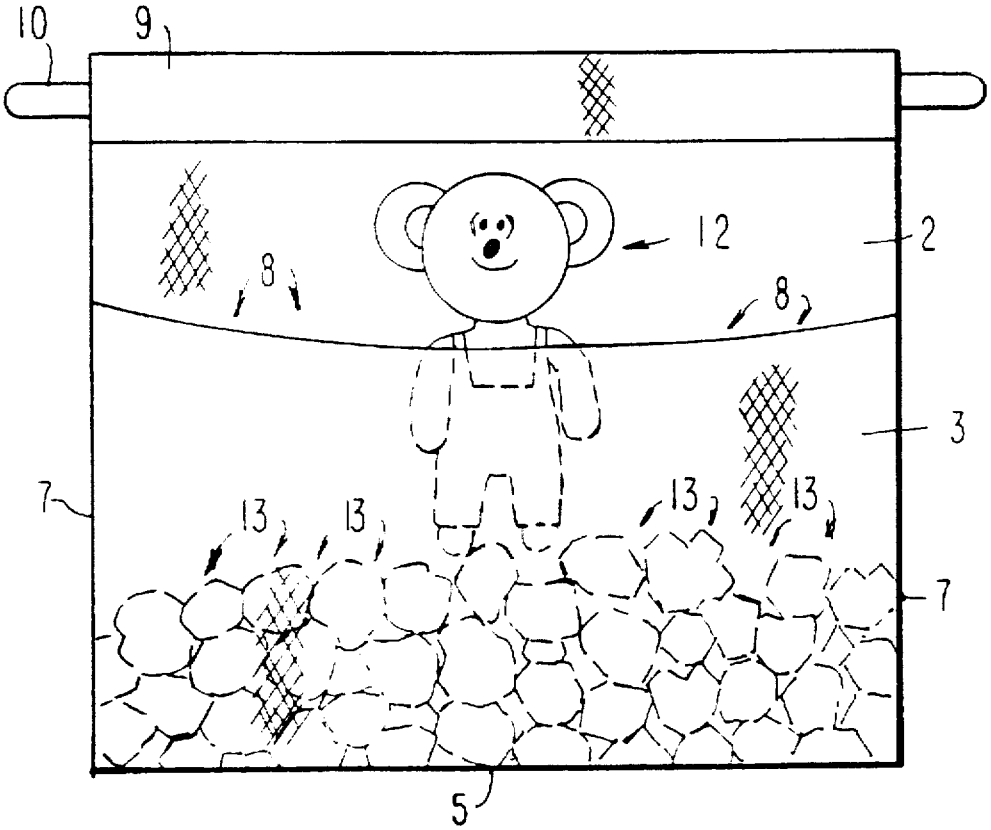
FIG. 5 is a front view of a one-pouch portion of the valance of FIG. 1, with a second expanding member shown in outline in the pouch.

Another preferred pouch expander that may be added to the valance includes loose fill 13, as shown in FIG. 5. Loose fill 13 is preferably disposed at the bottom of the pocket and thus is underneath and supports stuffed animal 12 as shown in FIG. 5. More or less loose fill is used, depending upon the size of the object being displayed in the pouch; the smaller the object, the greater the amount of loose fill would be needed. Loose fill 13 is preferably made of a material having a high volume-to-weight ratio, such as crumpled paper, foam rubber, styrofoam "peanuts", or the like.

Figure 6A:
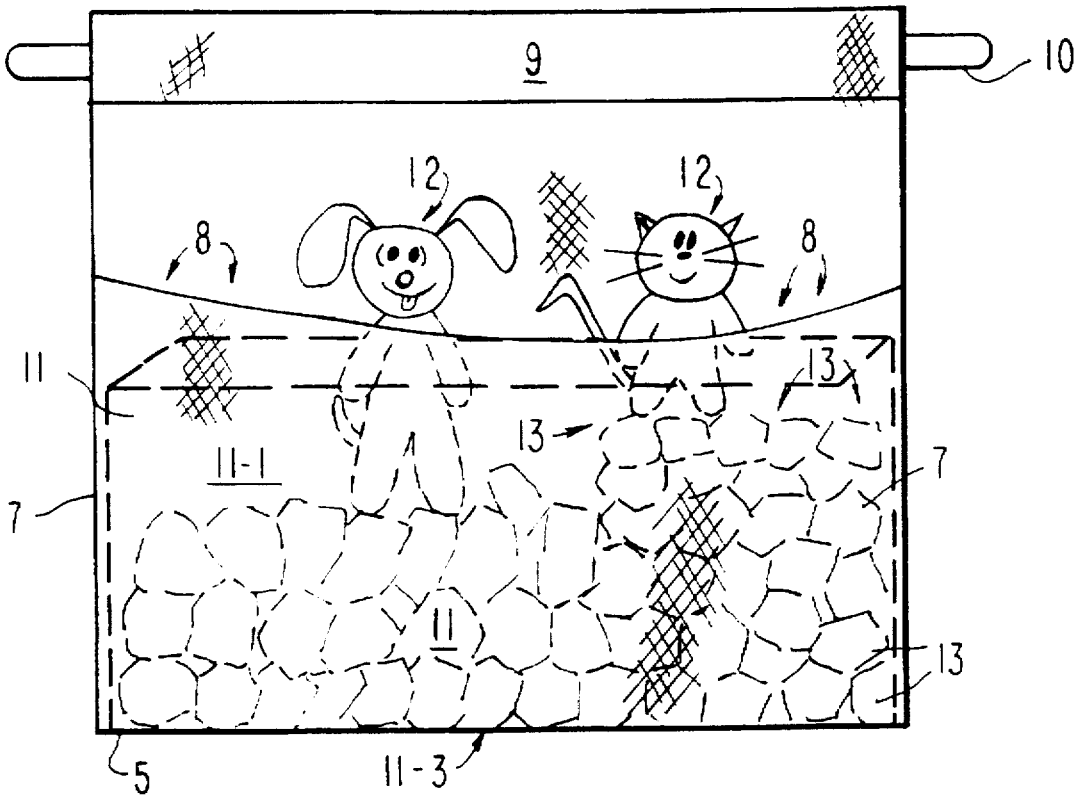
FIGS. 6*a*–6*b* are front views of a one-pouch portion of the valance of FIG. 1, with both expanding members shown in outline in the pouch in two different orientations.
Figure 6B:
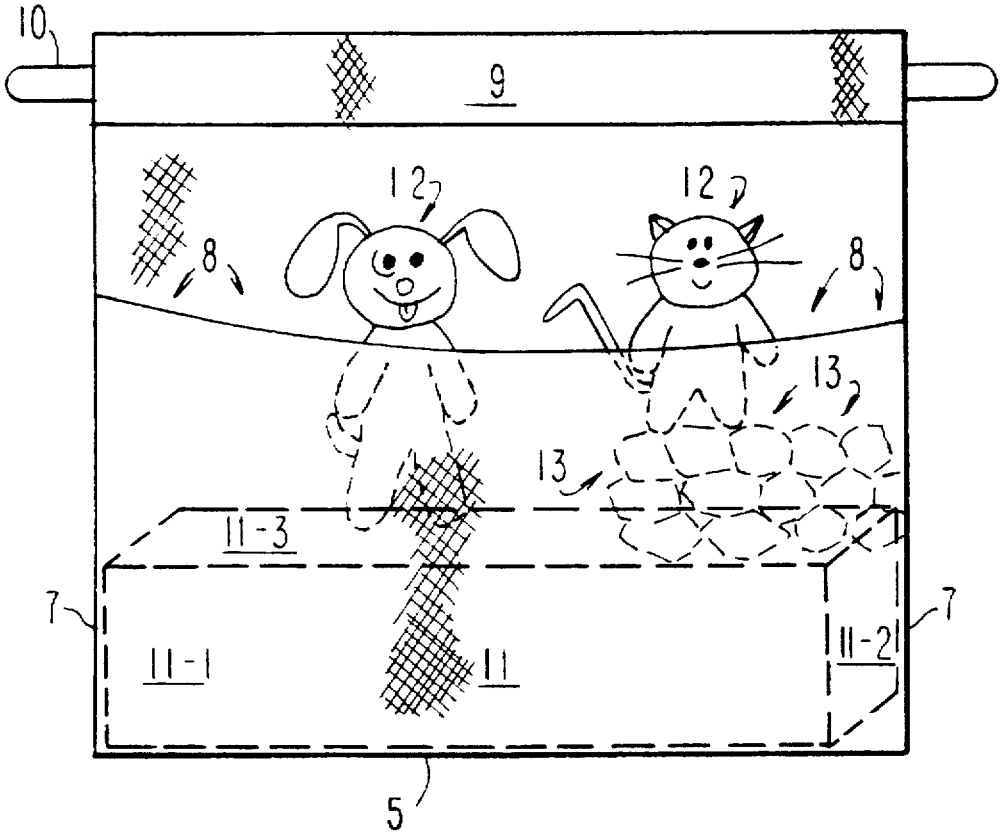

As a third alternative, both box member 11 and loose fill 13 may be used to expand the interior volume of the pouches. In one configuration, as shown in FIG. 6*a*, box member 11 is provided in pouch 8 with bottom wall 11-3 disposed downwardly, as in FIG. 4*a*. Loose fill 13 is placed inside box member 11, and stuffed animals are placed in the box member on top of the loose fill. More or less loose fill would be used, depending on the size of the objects being displayed. Similarly, as shown in FIG. 6*b*, box 11 may be inverted, and stuffed animal 12 may rest on top of bottom wall 11-3. Loose fill 13 may be disposed around the stuffed animal, or may be placed underneath the stuffed animal on top of bottom wall 11-3, to add height to the displayed item. Loose fill 13 may even be placed in pouch 8 first, and then box member 11 placed on top of loose fill 13, as shown in FIG. 7 in the right-most pouch.

Figure 7:
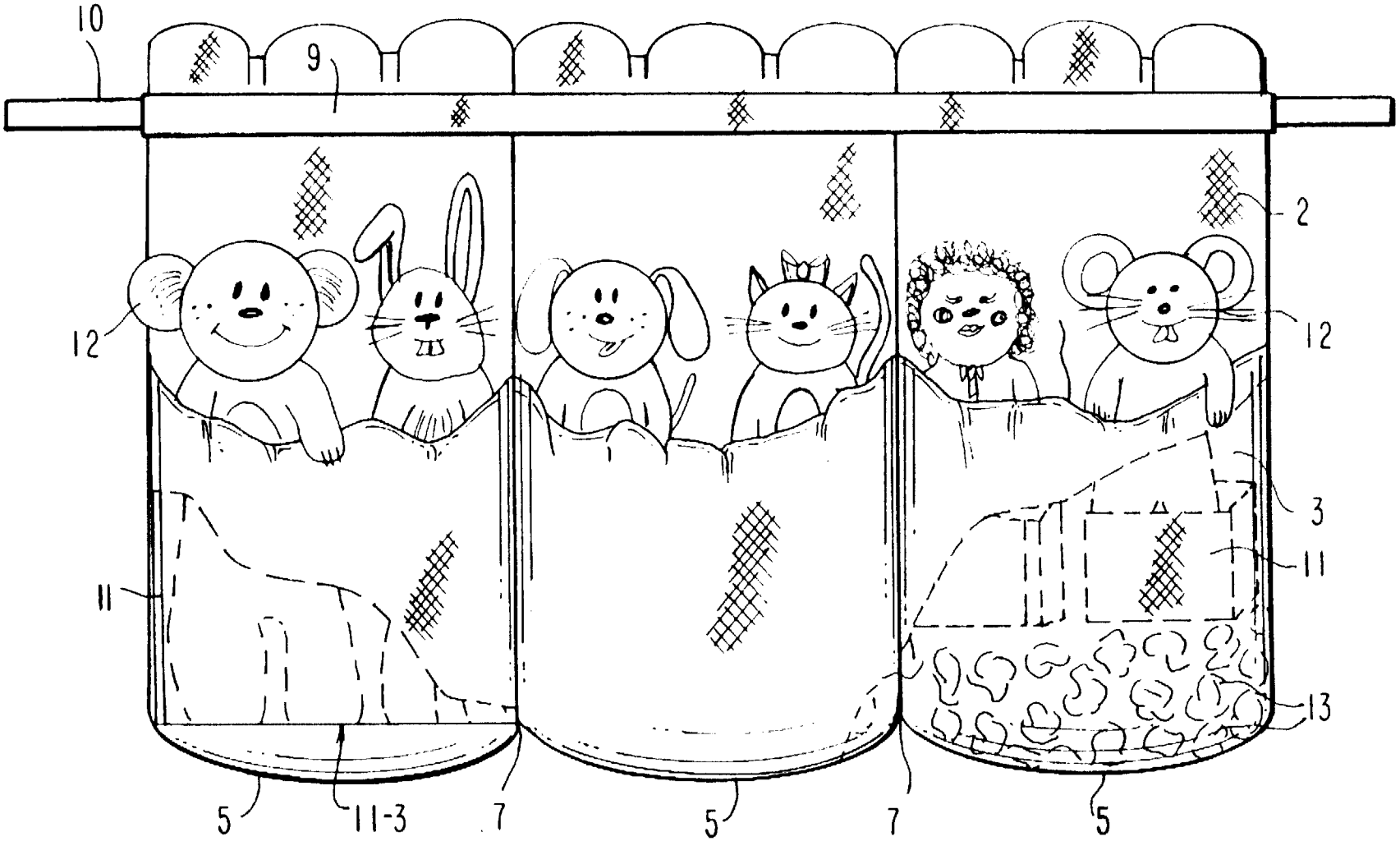
FIG. 7 is a front view of the first embodiment of the valance of FIG. 1 with broken-away portions showing different expanding member combinations.

Since each pouch may be separate from the other pouches, owing to vertical seams 7, each pouch may be provided with a different pouch expander, as shown in FIG. 7.

The invention is not limited to the embodiments described above. For example, the spacer is described above and illustrated as having front and rear walls, side walls, and a bottom wall. However, a spacer having fewer walls is also acceptable. One configuration provides a C-shaped spacer, having only a front wall and two side walls. A top or bottom wall may be added to provide a horizontal surface suitable for supporting the items.

In another example, the items are disposed in the pouches so that a portion of the items pokes out of the top of the pouches, thereby making the items at least partially visible. To make the items more visible, a pouch panel made of transparent or translucent material may be used. The pouch may be made from a clear plastic material, or may instead be formed from netting.

In another example, the pouches are described and illustrated as being disposed horizontally on the same single valance. However, there are multiple variations on the disposition of the pouches. First, pouches may be disposed one on top of the other vertically; the valance then may be made to emulate such long thin structures as a building, a rocket ship, or the like. Second, the pouches need not be all disposed on a single piece of fabric. Rather, each pouch may be formed on a single small mini-valance, and multiple mini-valances may be suspended from the same curtain rod. Such a configuration would be advantageous for several reasons. Aesthetically, each individual mini-valance could be designed to resemble a different three-dimensional object, or each could be designed to resemble a number of separable repetitive units of the same theme (e.g., train cars). For storage purposes, the mini-valance design is expandable, so that as a child obtains more stuffed animals and fills the initially available pockets, more pockets may be purchased at a later time to provide additional storage space.

What is claimed is:

1. A valance attachable to a support to be suspended from a wall and for storing and displaying an item, comprising:

a body having a front face and an upper portion;

a flexible pouch coupled to said front face of said body, said pouch having a front surface and being dimensioned to receive the item when said pouch is in an expanded state having greater volume than an unexpanded state;

a support attachment coupled to said upper portion of said body and attachable to the support to suspend said body from the support; and expanding means, disposed within said pouch, for holding said pouch in said expanded state, and for imparting a three-dimensional appearance to said pouch.

2. A valance according to claim 1, wherein said pouch is joined to said body along respective horizontal edges to form a horizontal seam and along at least two vertical edges to form outer vertical seams, said horizontal seam and said outer vertical seams defining said pouch.

3. A valance according to claim 2, further comprising intermediate vertical seams, joining said body and said pouch together and disposed between said outer vertical seams, said intermediate and outer vertical seams and said horizontal seam defining a plurality of pouches adapted to receive a plurality of items.

4. A valance according to claim 1, wherein said expanding means comprises a spacer, said spacer being disposed in said pouch and having a front wall and side walls, thereby spacing said front surface of said pouch away from said body.

5. A valance according to claim 4, wherein said spacer further comprises a bottom wall and thus defines an interior volume within said spacer, said spacer being disposed in said pouch with said bottom wall oriented downward, said interior volume of said spacer being adapted to receive the item.

6. A valance according to claim 4, wherein said spacer further comprises a top wall and is disposed in said pouch with said top wall oriented upward, said top wall being adapted to support the item.

7. A valance according to claim 1, wherein said expanding means comprises loose fill, disposed in a bottom portion of said pouch, thereby spacing said front surface of said pouch away from said body.

8. A valance according to claim 5, wherein said expanding means further comprises loose fill, disposed in said interior volume of said spacer, said loose fill being adapted to support the item.

9. A valance according to claim 6, wherein said expanding means further comprises loose fill, disposed on top of said top wall of said spacer, said loose fill being adapted to support the item.

10. A valance according to claim 3, wherein each of said plurality of pouches is provided with one of a plurality of said expanding means, said expanding means being adapted to support the items.

11. A valance according to claim 10, wherein each one of said expanding means comprises at least one of:

a spacer, having a front wall and side walls, and at least one of a top wall and a bottom wall, thereby spacing said front surface of said pouch away from said body and defining an interior volume of said spacer; and loose fill, disposed one of a) on top of said top wall and b) inside said interior volume of said spacer.

12. A valance according to claim 1, wherein said body further comprises a plurality of loops attached to said front face of said body, and wherein said pouch is threaded through said loops and allowed to droop between said loops.

13. A valance according to claim 12, wherein said expanding means comprises loose fill disposed in said at least one pouch, said loose fill being adapted to support the item.

14. A valance according to claim 1, wherein said expanding means elevate the items so that a vertical portion of the item is above said pouch, thereby making the item partially visible when placed in said pouch.

15. A valance according to claim 1, wherein said items are toys, comprising of at least one of dolls, stuffed animals, and plush toys.

16. A valance according to claim 1, wherein said support attachment comprises a rod compartment, adapted to receive a curtain rod, for securing said valance to the wall.

17. A valance attachable to a support to be suspended from a wall and for storing and displaying an item, comprising:

a body having a front face and an upper portion;

a flexible pouch coupled to said front face of said body, said pouch having a volume sufficient to accommodate the item and having a depth greater than a vertical portion of the item to be concealed in said pouch;

a support attachment coupled to said upper portion of said body and attachable to the support to suspend said body from the support; and support means, disposed in said pouch, for supporting the item above a lower end of said pouch so that the desired vertical portion of the item is displayed above the upper edge of said pouch.

18. A valance according to claim 17, wherein said support means comprises a spacer having a front wall and side walls and a top wall and is disposed in said pouch with said top wall oriented upward, said top wall being adapted to support the item.

19. A method of constructing a valance attachable to a support to be suspended from a wall and for storing and displaying an item, comprising the steps of:

selecting first and second fabric panels, each of said panels having a predetermined size and having a front face and a back face; and coupling said first panel to said second panel with said back face of said second panel facing said front face of said first panel thereby forming a pouch, said coupling step further comprising the steps of:

attaching loops on said front face of said first panel;

threading said second panel through said loops; and allowing said second panel to droop between said loops, thereby forming a pouch.

* * * * *